US010424863B1

(12) United States Patent
Zhuang et al.

(10) Patent No.: US 10,424,863 B1
(45) Date of Patent: Sep. 24, 2019

(54) ELECTRICAL RECEPTACLE AND TAMPER-RESISTANT SHUTTER ASSEMBLY THEREFOR

(71) Applicant: EATON INTELLIGENT POWER LIMITED, Dublin (IE)

(72) Inventors: Chuanchuan Zhuang, Shanghai (CN); Fengguo Zhang, Shanghai (CN); Erik Jeffrey Gouhl, Fayetteville, GA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/188,682

(22) Filed: Nov. 13, 2018

(51) Int. Cl.
*H01R 13/453* (2006.01)
*H01R 25/00* (2006.01)
*H01R 24/78* (2011.01)

(52) U.S. Cl.
CPC ..... *H01R 13/4534* (2013.01); *H01R 13/4532* (2013.01); *H01R 24/78* (2013.01); *H01R 25/006* (2013.01)

(58) Field of Classification Search
CPC ..... H01R 13/447; H01R 13/453; H01R 13/4532; H01R 13/4534; H01R 13/4536; H01R 13/4538
See application file for complete search history.

(56) References Cited

U.S. PATENT DOCUMENTS 4,379,607 A 4/1983 Bowden, Jr.
4,544,219 A 10/1985 Barkas
4,584,430 A 4/1986 Belknap
4,618,740 A 10/1986 Ray et al.
4,722,693 A 2/1988 Rose
5,006,075 A 4/1991 Bowden, Jr.
5,856,633 A 1/1999 Zelkovsky
5,915,981 A 6/1999 Mehta
6,004,043 A 12/1999 Abendschein et al.
D419,531 S 1/2000 Keung et al.
6,056,564 A 5/2000 Huang
6,108,482 A 8/2000 Roth
6,111,210 A 8/2000 Allison
6,217,353 B1 4/2001 Yu-Tse
6,425,694 B1 7/2002 Szilagyi et al.
D470,108 S 2/2003 Daoxian et al.
6,537,099 B2 3/2003 Herlinger et al.
6,555,771 B2 4/2003 Shao
6,595,696 B1 7/2003 Zellak
6,674,003 B1 1/2004 Torres
(Continued)

*Primary Examiner* — Ross N Gushi
(74) *Attorney, Agent, or Firm* — Eckert Seamans Cherin & Mellott, LLC

(57) ABSTRACT

A shutter assembly is for an electrical receptacle. The electrical receptacle has a base. The shutter assembly includes a first shutter and a second shutter each structured to be coupled to the base and rotate between a FIRST position and a SECOND position, and a slider assembly having a number of slider members each structured to be coupled to the base. The number of slider members includes only one single slider member structured to slide between a THIRD position and a FOURTH position and engage each of the first shutter and the second shutter. Rotation of both of the first shutter and the second shutter from the FIRST position to the SECOND position cooperatively drives the one single slider member from the THIRD position to the FOURTH position in order to provide access through the base.

20 Claims, 18 Drawing Sheets

(56) References Cited

U.S. PATENT DOCUMENTS 6,688,780 B2 2/2004 Duran
6,715,930 B2 4/2004 McBride
6,749,449 B2 6/2004 Mortun et al.
6,776,630 B1 8/2004 Huang
6,786,745 B1 9/2004 Huang
6,814,594 B1 11/2004 Huang
6,843,680 B2 1/2005 Gorman
6,845,210 B2 1/2005 Ohbayashi et al.
6,866,535 B2 3/2005 Uchida
6,877,999 B2 4/2005 Hashimoto
6,893,275 B2 5/2005 Ng et al.
6,926,550 B2 8/2005 Ursich
6,942,503 B2 9/2005 Yamaguchi et al.
6,969,801 B2 11/2005 Radosavljevic et al.
D515,505 S 2/2006 Lin
7,025,609 B2 4/2006 Matsumoto et al.
7,144,163 B2 12/2006 Tanaka et al.
7,144,271 B1 12/2006 Burris et al.
7,160,147 B1 1/2007 Stephan
7,179,992 B1 2/2007 Packard et al.
D542,223 S 5/2007 Bazayev et al.
7,214,101 B1 5/2007 Tong
D545,272 S 6/2007 Zhang et al.
7,234,954 B1 6/2007 Srage et al.
7,312,394 B1 12/2007 Weeks et al.
7,312,963 B1 12/2007 Radosavljevic et al.
7,355,117 B2 4/2008 Castaldo et al.
7,452,221 B1 11/2008 Oddsen et al.
7,510,412 B1 3/2009 Valentin
7,551,047 B2 6/2009 Sokolow et al.
7,556,513 B2 7/2009 Ng et al.
7,588,447 B1 9/2009 Ni
7,642,457 B2 1/2010 Weeks et al.
7,645,148 B2 1/2010 Carbone et al.
7,645,149 B2 1/2010 Carbone et al.
7,648,286 B2 1/2010 Nakagawa
7,651,347 B2 1/2010 Germain et al.
7,686,518 B2 3/2010 Case et al.
7,695,293 B1 4/2010 Sikes
7,736,174 B2 6/2010 Bhosale et al.
7,753,700 B2 7/2010 Ma
7,785,018 B2 8/2010 Jones et al.
7,820,909 B2 10/2010 Castaldo et al.
7,825,546 B2 11/2010 Li et al.
7,841,777 B2 11/2010 Howard et al.
7,887,346 B1 2/2011 Huang
7,931,482 B2 4/2011 Liao
7,934,935 B1 5/2011 Gao
7,938,676 B1 5/2011 Patel et al.
7,942,681 B2 5/2011 Ni
7,985,085 B2 7/2011 Gao
8,007,296 B2 8/2011 Chen et al.
8,044,299 B2 10/2011 Weeks
8,062,072 B2 11/2011 Ziobro
8,164,403 B2 4/2012 Li
8,187,011 B1 * 5/2012 Baldwin ..... H01R 13/4534 439/137
8,187,012 B1 * 5/2012 Baldwin ..... H01R 13/4534 439/137
8,193,445 B2 6/2012 Li
8,242,362 B2 8/2012 Castaldo et al.
8,297,990 B2 10/2012 Huang
8,435,055 B1 5/2013 Bhosale
D686,577 S 7/2013 Flagello
8,480,420 B2 7/2013 Ziobro
8,491,319 B1 * 7/2013 Baldwin ..... H01R 13/4534 439/137
8,568,152 B1 10/2013 Weeks
8,632,347 B2 1/2014 Chen et al.
8,672,695 B2 * 3/2014 Baldwin ..... H01R 13/4534 439/137
8,726,971 B2 5/2014 Sato et al.
8,795,006 B2 8/2014 Hoffman
8,802,979 B2 8/2014 Ziobro
8,974,239 B2 3/2015 Tomimbang
9,059,529 B1 6/2015 Lai
9,059,530 B2 6/2015 Byrne et al.
9,196,995 B2 * 11/2015 Scanzillo ..... H01R 13/453
9,196,997 B2 11/2015 Sanders et al.
D744,952 S 12/2015 Ni et al.
D754,074 S 4/2016 DeCosta
D763,196 S 8/2016 DeCosta
9,407,033 B2 8/2016 Kong et al.
9,450,365 B1 9/2016 Baldwin et al.
9,478,892 B2 10/2016 Scanzillo et al.
9,502,806 B2 11/2016 Ewer et al.
9,502,807 B2 11/2016 Mortun et al.
9,520,670 B2 12/2016 Bazayev
9,531,108 B2 12/2016 Bazayev
9,543,685 B2 * 1/2017 Mortun ..... H01R 13/4534
9,543,715 B2 1/2017 Savicki, Jr.
9,614,316 B2 4/2017 Li
9,647,376 B2 5/2017 Samojeden et al.
9,692,189 B2 6/2017 Lin
9,761,985 B1 9/2017 Peng
D798,818 S 10/2017 Kondas
D800,662 S 10/2017 Wu
9,847,611 B2 12/2017 Savicki, Jr.
9,887,483 B2 2/2018 Zhang et al.
9,893,456 B2 2/2018 Savicki, Jr.
9,913,778 B2 3/2018 Dvorak et al.
2007/0114053 A1 5/2007 Castaldo et al.
2008/0156512 A1 7/2008 Castaldo et al.
2009/0227130 A1 9/2009 Carbone et al.
2009/0227131 A1 9/2009 Carbone et al.
2009/0236115 A1 9/2009 Li
2010/0130053 A1 5/2010 Ziobro
2010/0159722 A1 6/2010 Chen
2010/0228141 A1 9/2010 Kountotsis
2011/0028011 A1 2/2011 Castaldo et al.
2011/0079414 A1 4/2011 Ziobro
2011/0263145 A1 10/2011 Kim
2013/0109207 A1 5/2013 Bhosale
2014/0051287 A1 2/2014 Liao
2014/0065862 A1 3/2014 Tomimbang
2015/0372410 A1 12/2015 Li
2015/0372411 A1 12/2015 Ewer et al.
2015/0372412 A1 12/2015 Samojeden et al.
2015/0380856 A1 12/2015 Mortun et al.
2016/0013577 A1 1/2016 Diakomis et al.
2016/0087368 A1 3/2016 Bazayev
2016/0087369 A1 3/2016 Bazayev
2016/0261078 A1 9/2016 Sandel
2017/0279214 A1 9/2017 Lee et al.
2017/0352978 A1 12/2017 Mortun
2017/0358886 A1 12/2017 Scanzillo et al.
2018/0090870 A1 3/2018 Naaman

* cited by examiner

ELECTRICAL RECEPTACLE AND TAMPER-RESISTANT SHUTTER ASSEMBLY THEREFOR

BACKGROUND

Field

The disclosed concept relates generally to electrical apparatus and, more particularly, to electrical apparatus such as electrical receptacles. The disclosed concept also relates to shutter assemblies for electrical receptacles.

Background Information

Electricity is often provided to electric devices via an electrical power cord including a plug, which is plugged into an electrical receptacle. Electrical receptacles typically include two sockets coupled together with a common housing, wherein each socket is adapted to receive the plug to thereby provide power via the corresponding power cord. More specifically, each plug includes a number of conductors commonly referred to as prongs, which are structured to be inserted into openings in the corresponding receptacle to engage electrical contacts.

A Ground Fault Circuit Interrupter (GFCI), for example, is a type of electrical receptacle with a safety feature for restricting electrical current in the event of a fault. That is, in the event that a short circuit or other fault is detected, the GFCI cuts off power to the electrical receptacle contacts until a user resets the GFCI. It is desirable to provide additional safety measures for electrical receptacles, for example in order to resist unintentional or undesired insertion of conductive objects into the openings of a receptacle to avoid electrical shock.

There is, therefore, room for improvement in electrical receptacles, and in shutter assemblies therefor.

SUMMARY

These needs and others are met by embodiments of the disclosed concept, which are directed to an electrical receptacle and a tamper-resistant shutter assembly therefor.

In accordance with one embodiment of the disclosed concept, a shutter assembly is provided for an electrical receptacle. The shutter assembly includes a base, a first shutter and a second shutter each coupled to the base and structured to rotate between a FIRST position and a SECOND position, and a slider assembly having a number of slider members each structured to be coupled to the base. The number of slider members includes only one single slider member structured to slide between a THIRD position and a FOURTH position and engage each of the first shutter and the second shutter. Rotation of both of the first shutter and the second shutter from the FIRST position to the SECOND position cooperatively drives the one single slider member from the THIRD position to the FOURTH position in order to provide access through the base.

In accordance with another embodiment of the disclosed concept, an electrical receptacle including a faceplate and the aforementioned shutter assembly is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
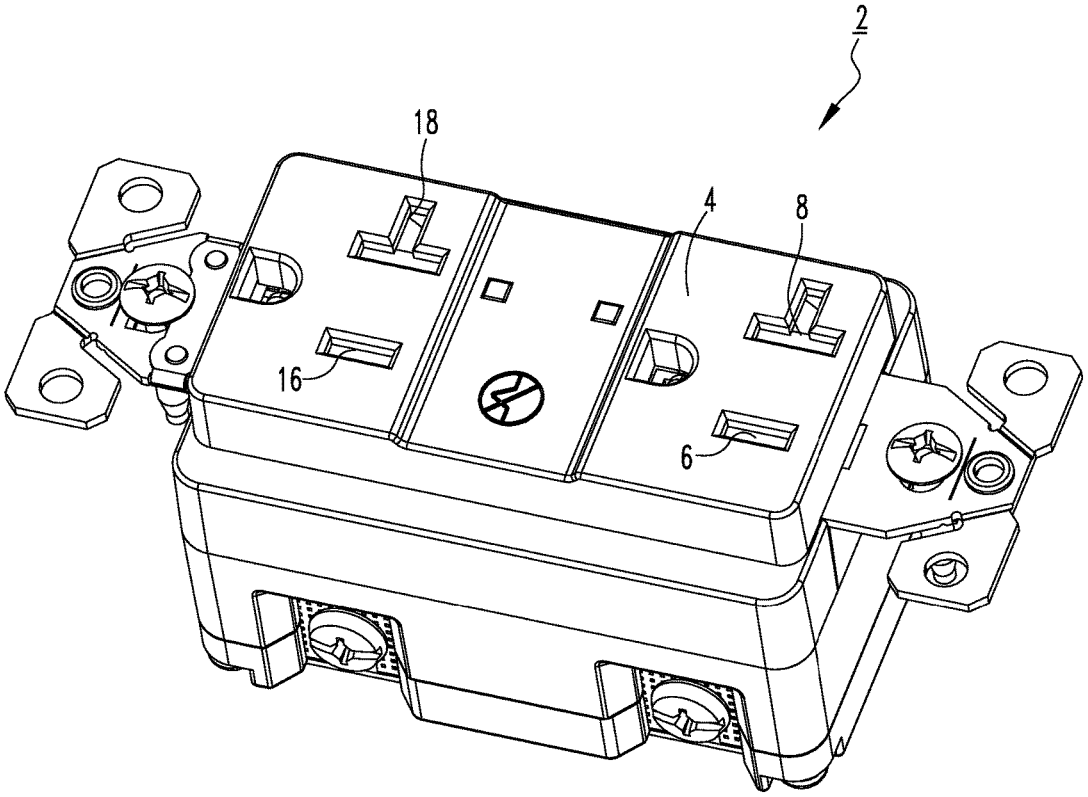
FIG. 1 is a isometric view of an electrical receptacle and shutter assembly therefor, in accordance with one non-limiting embodiment of the disclosed concept.

Directional phrases used herein, such as, for example, left, right, front, back, top, bottom, clockwise, counterclockwise, and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
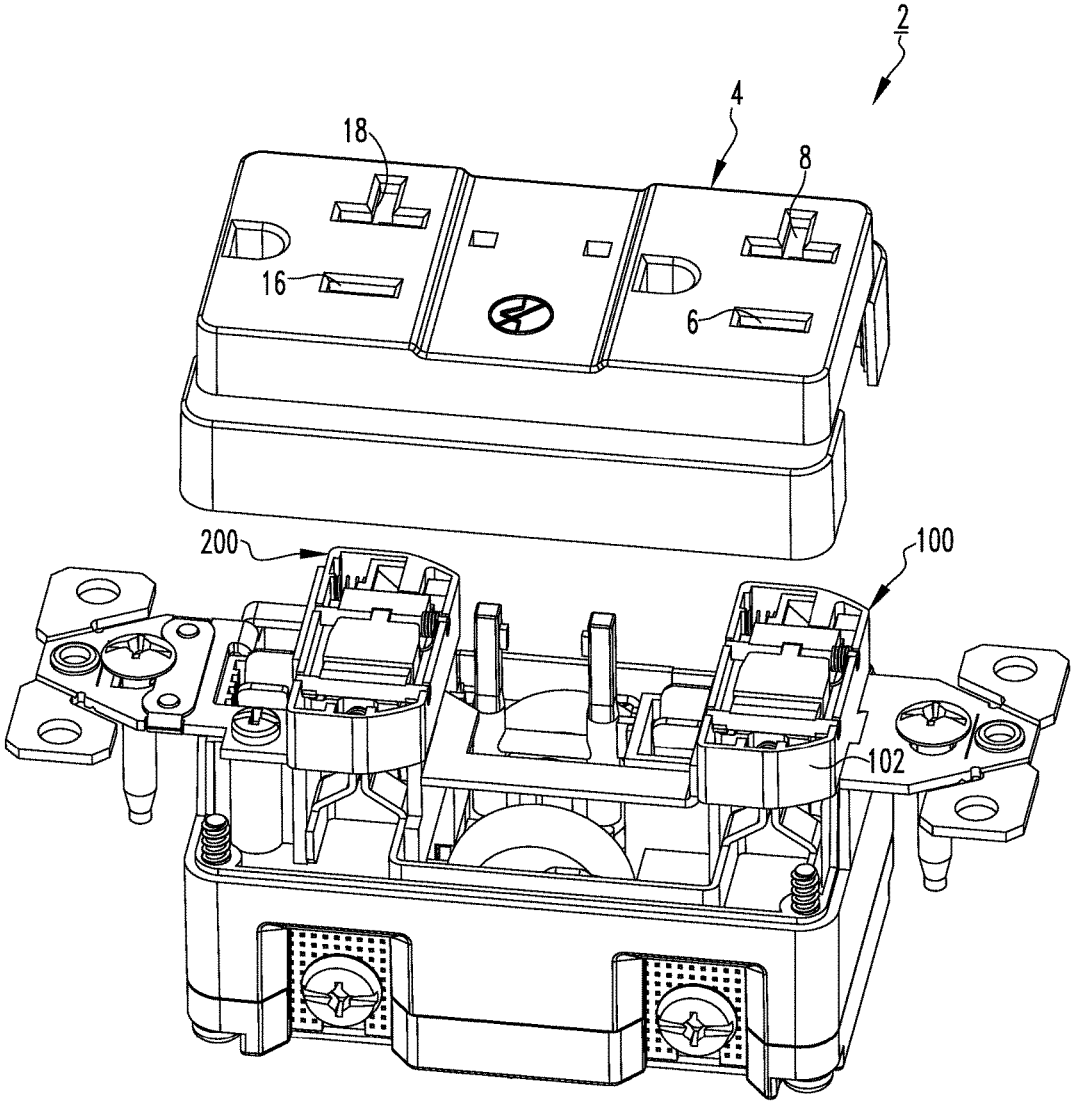
FIG. 2 is a partially exploded isometric view of the electrical receptacle and shutter assembly therefor of FIG. 1.

FIGS. 1 and 2 are isometric and partially exploded isometric views, respectively, of an electrical apparatus (e.g., without limitation, electrical receptacle 2), in accordance with one non-limiting embodiment of the disclosed concept. The electrical receptacle 2 has a faceplate 4 and a number of shutter assemblies (e.g., two shutter assemblies 100,200 are shown in FIG. 2). Although two shutter assemblies 100,200 are shown in FIG. 2, only the shutter assembly 100 will be described in detail herein, for ease of illustration and economy of disclosure. However, it will be appreciated that the shutter assembly 200 is configured substantially the same, and functions substantially the same, as the shutter assembly 100. The faceplate 4 has two pairs of openings (e.g., rectangular and T-shaped openings 6,8, and rectangular and T-shaped openings 16,18). The T-shaped openings 8,18 are to allow the electrical receptacle 2 to accommodate a 20 amp electrical plug having perpendicularly oriented blade members. See, for example, blade members 400,500 in FIGS. 9A-9C. As will be discussed below, the shutter assemblies 100,200 provide a mechanism to substantially ensure that only proper electrical plugs are able to be extended through the faceplate 4 and shutter assemblies 100,200, and into electrical contacts of the electrical receptacle 2. Accordingly, the disclosed shutter assemblies 100, 200 improve operator safety.

Figure 3:
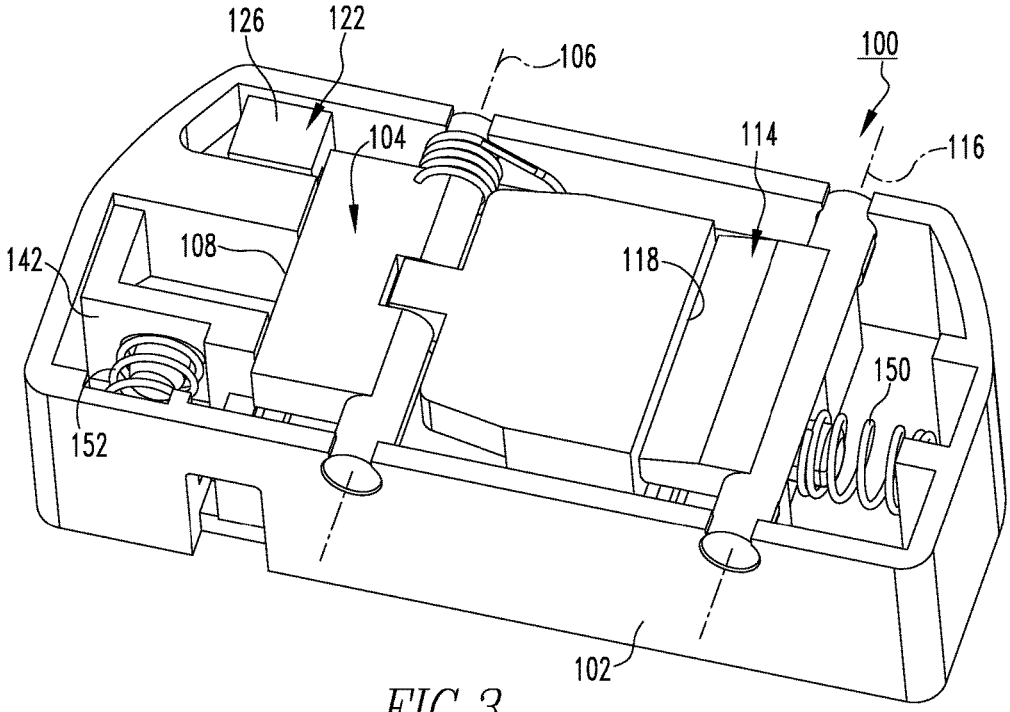
FIG. 3 is a isometric view of the shutter assembly of FIG. 2.
Figure 4:
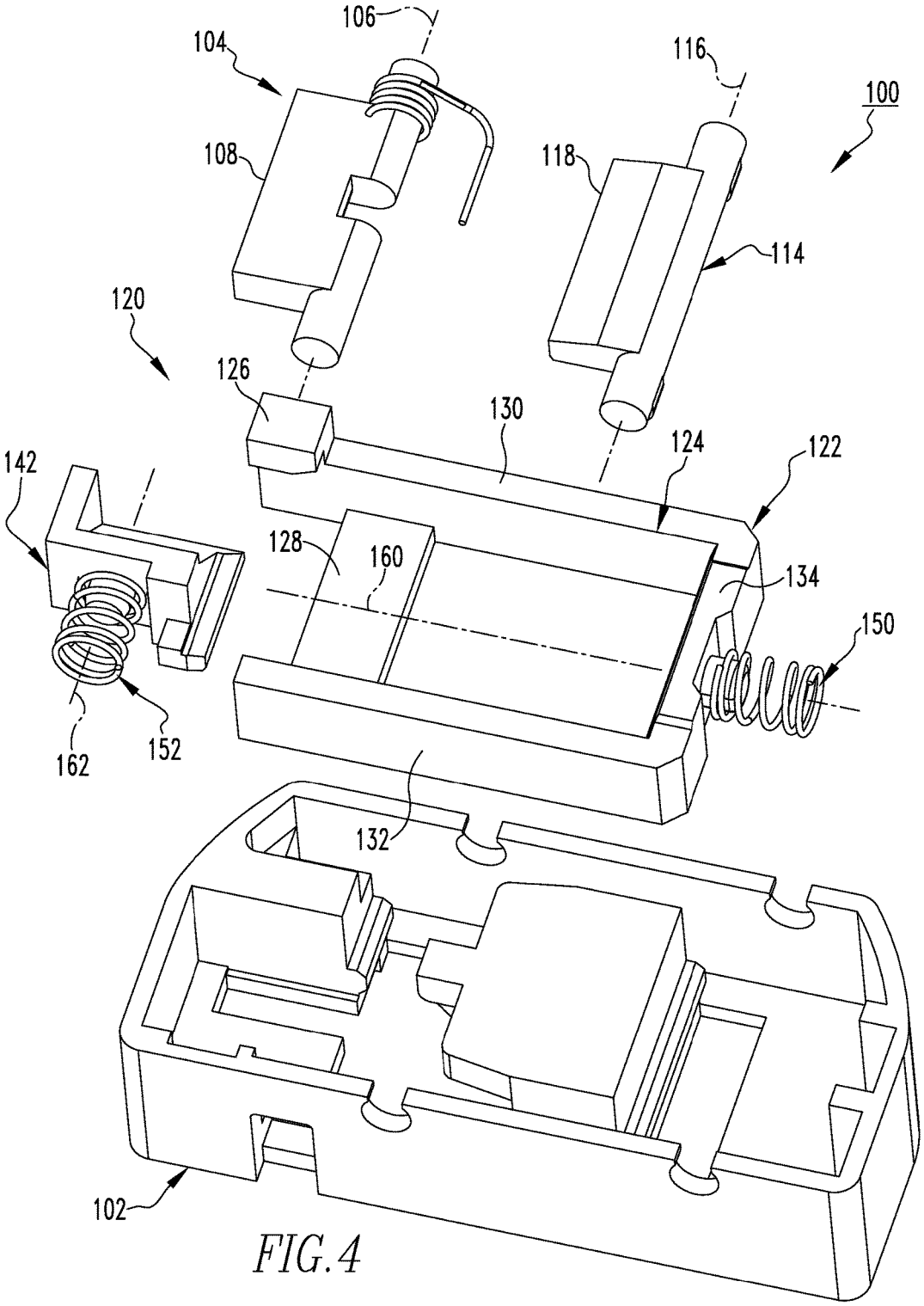
FIG. 4 is an exploded isometric view of the shutter assembly of FIG. 3.

FIGS. 3 and 4 show isometric and exploded isometric views, respectively, of the shutter assembly 100. The shutter assembly 100 includes a base 102 and a pair of shutters 104,114 each coupled to the base 102. In one example embodiment, the base 102 is made of an insulative thermoplastic material, and is coupled to the faceplate 4 (FIGS. 1 and 2) of the electrical receptacle 2 (FIGS. 1 and 2). The shutters 104,114 are each structured to rotate between a FIRST position (shown in FIG. 3) and a SECOND position (shown in FIGS. 8A-9C). When each of the shutters 104,114 rotates from the FIRST position to the SECOND position, each of the shutters has a corresponding axis of rotation 106,116 and a distal portion 108,118 located opposite and distal the corresponding axis of rotation 106,116. The shutter assembly 100 further includes a slider assembly 120 having a number of slider members 122,142 and a number of biasing elements (e.g., springs 150,152). Although the shutter assembly 100 is shown and described in association with two slider members 122,142, it will be appreciated that in a suitable alternative shutter assembly, only one single slider member (e.g., without limitation, the slider member 122) may be employed, with departing from the scope of the disclosed concept.

Only one single slider member (e.g., the slider member 122) is structured to slide between a THIRD position (FIG. 3) and a FOURTH position (FIGS. 8A-9C) and also engage each of the first shutter 104 and the second shutter 114. When the slider member 122 slides between the THIRD position and the FOURTH position, the slider member 122 slides on a first axis 160. The second slider member 142 is structured to slide between a FIFTH position, shown in FIGS. 3 and 5A-6C, and a SIXTH position shown in FIGS. 9A-9C. When the second slider member 142 slides between the FIFTH position and the SIXTH position, the second slider member 142 slides on a second axis 162 perpendicular to the first axis 160. As will be discussed in greater detail below, rotation of both of the shutters 104,114 from the FIRST position to the SECOND position cooperatively drives the one single slider member 122 from the THIRD position to the FOURTH position in order to provide access through the base 102.

The slider member 122 has a generally U-shaped frame portion 124 and a plurality of blocking portions 126,128 extending from the frame portion 124. The frame portion 124 has a pair of opposing, and generally parallel legs 130,132, and a middle portion 134 extending between the legs 130,132. It will be appreciated that when the first and second shutters 104,114 are in the SECOND position, the respective distal portions 108,118 are located between the first and second legs 130,132 of the slider member 122. The first blocking portion 126 extends outwardly from the first leg 130 substantially toward the slider member 142. The second blocking portion 128 is spaced from, and located opposite and distal to the middle portion 134. The first shutter 104 is substantially located between the second slider member 142 and the second shutter 114. Furthermore, as shown in FIG. 4, the second blocking portion 128 is located substantially perpendicular to the first and second legs 130,132 of the frame portion 124. The springs 150,152 are each coupled to and extend outwardly from a respective one of the slider members 122,142, for purposes that will be discussed below. In one example embodiment, the first spring 150 is substantially equidistant from the first leg 130 and the second leg 132.

Figure 5A:
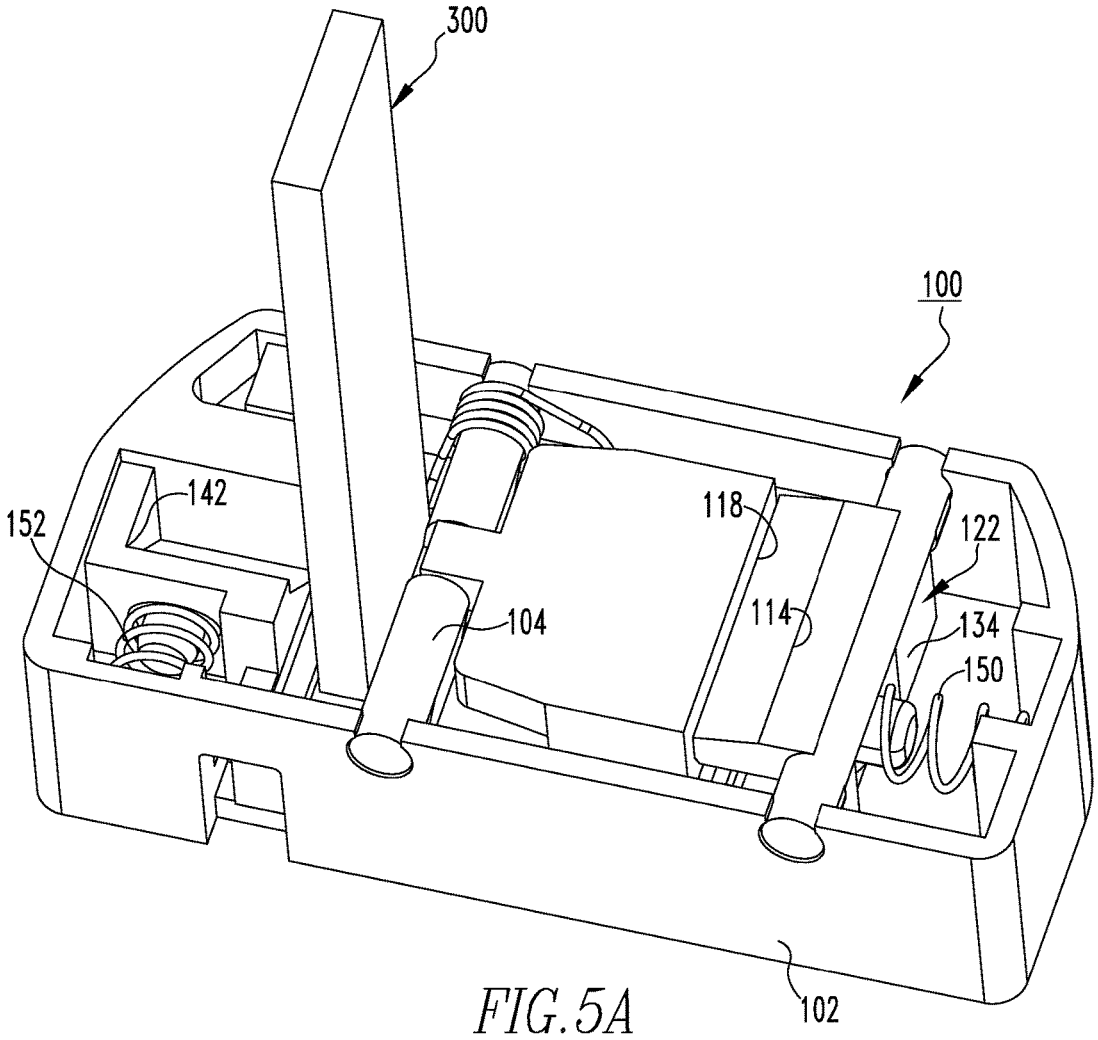
FIG. 5A is an assembled isometric view of the shutter assembly of FIG. 3, and shown with a blade member partially extended into a portion of the shutter assembly and blocked from having access through the shutter assembly.
Figure 5B:
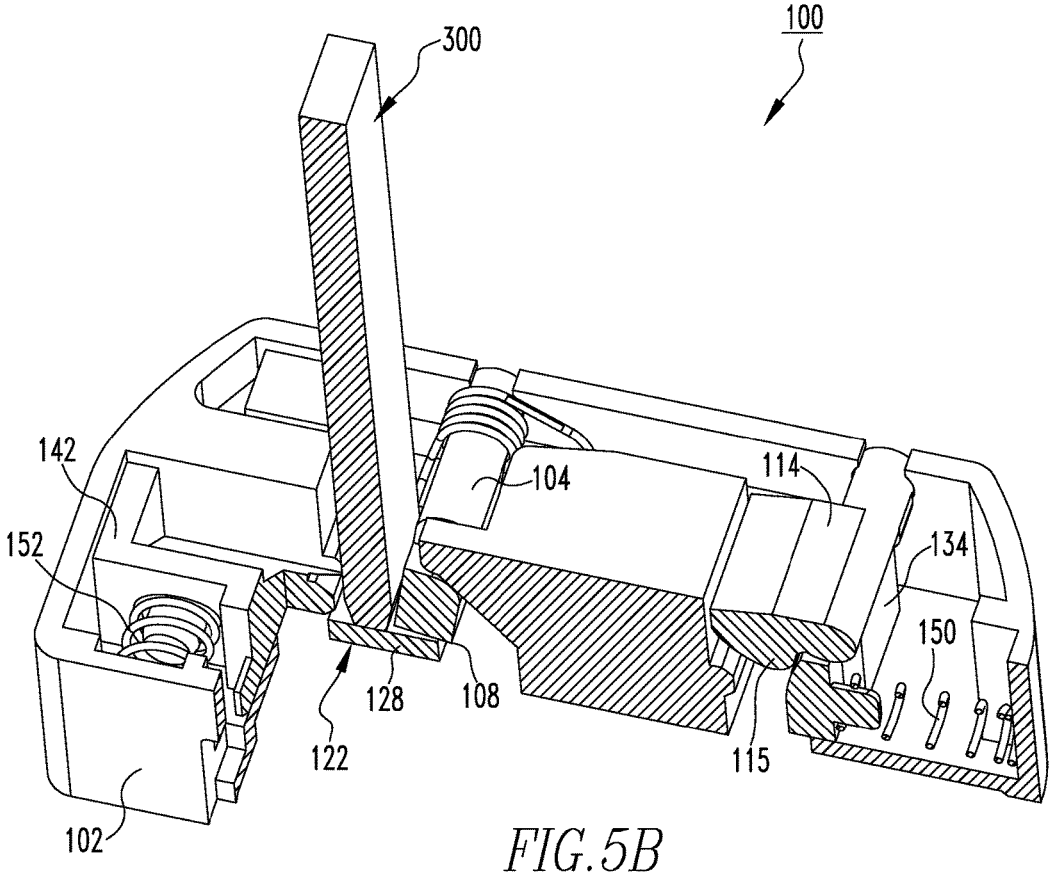
FIG. 5B is an isometric section view of the shutter assembly, with blade member, of FIG. 5A.
Figure 5C:
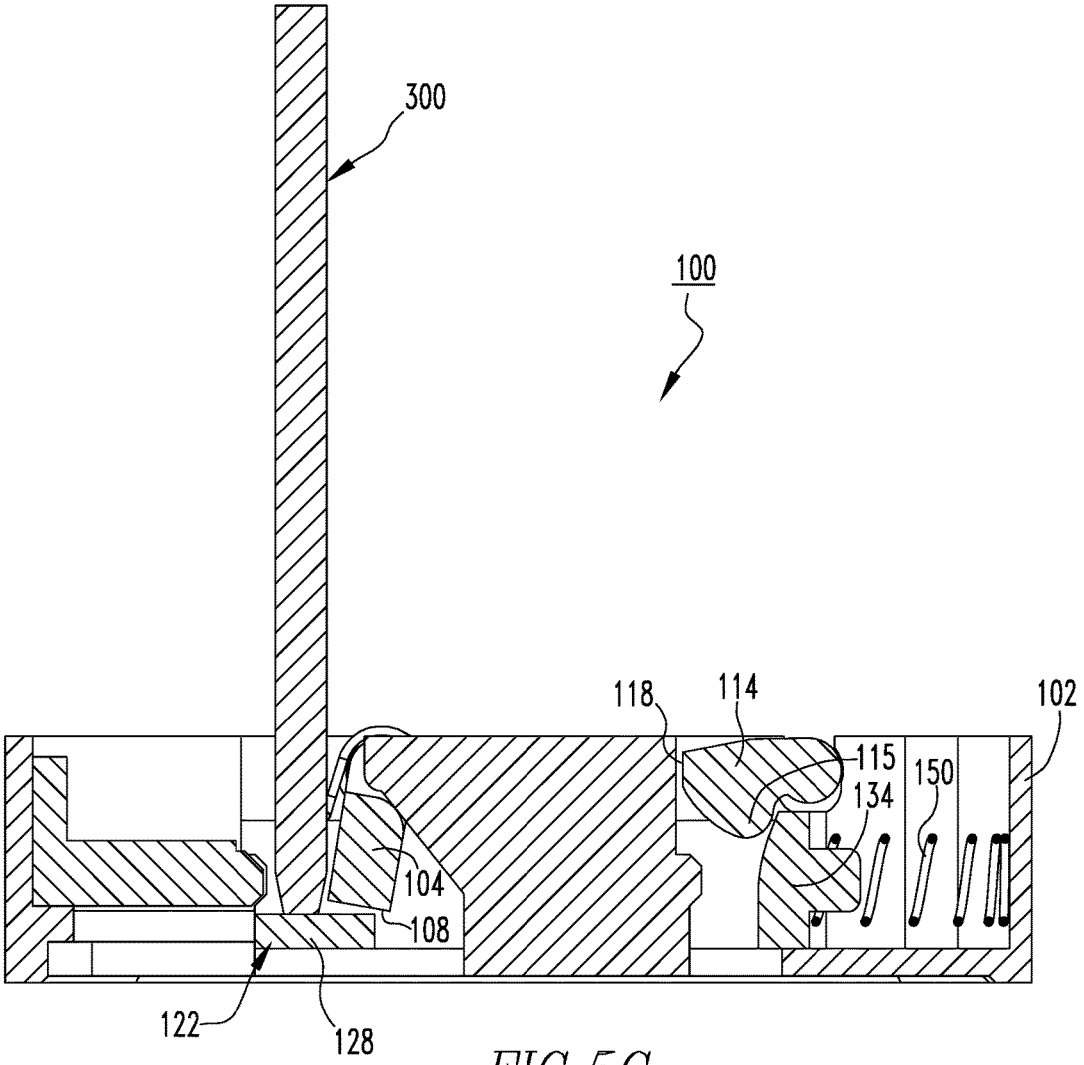
FIG. 5C is an elevation section view of the shutter assembly, with blade member, of FIG. 5A.

FIGS. 5A-5C show different views of the shutter assembly 100 with a blade member 300 partially inserted. As shown, the first shutter 104 has been rotated to the SECOND position. However, as shown most clearly in FIGS. 5B and 5C, the blade member 300 is engaged with the second blocking portion 128 of the slider member 122 and is prevented from moving through the shutter assembly 100. It will be appreciated that in this position, e.g., a position wherein the single slider member 122 is still in the THIRD position and has generally not been moved at all, the blade member 300 is blocked from having access through the shutter assembly 100, e.g., and into an electrical contact of the electrical receptacle 2 (FIGS. 1 and 2). As such, when only the first shutter 104 rotates from the FIRST position to the SECOND position, the second blocking portion 128 blocks access through the base 102 proximate the first shutter 104. Accordingly, as the electrical receptacle 2 (FIGS. 1 and 2) is not intended to accommodate only one single blade member at a given time, or one single probe member of any kind at a given time, the shutter assembly 100 thus provides advantageous protection to operators who might attempt to do this, e.g., insert only one single probe member, whether intentionally or otherwise. Stated differently, the shutter assembly 100 makes the electrical receptacle 2 (FIGS. 1 and 2) safer because a user cannot simply insert an object that is not intended to be inserted, through the shutter assembly 100.

Figure 6A:
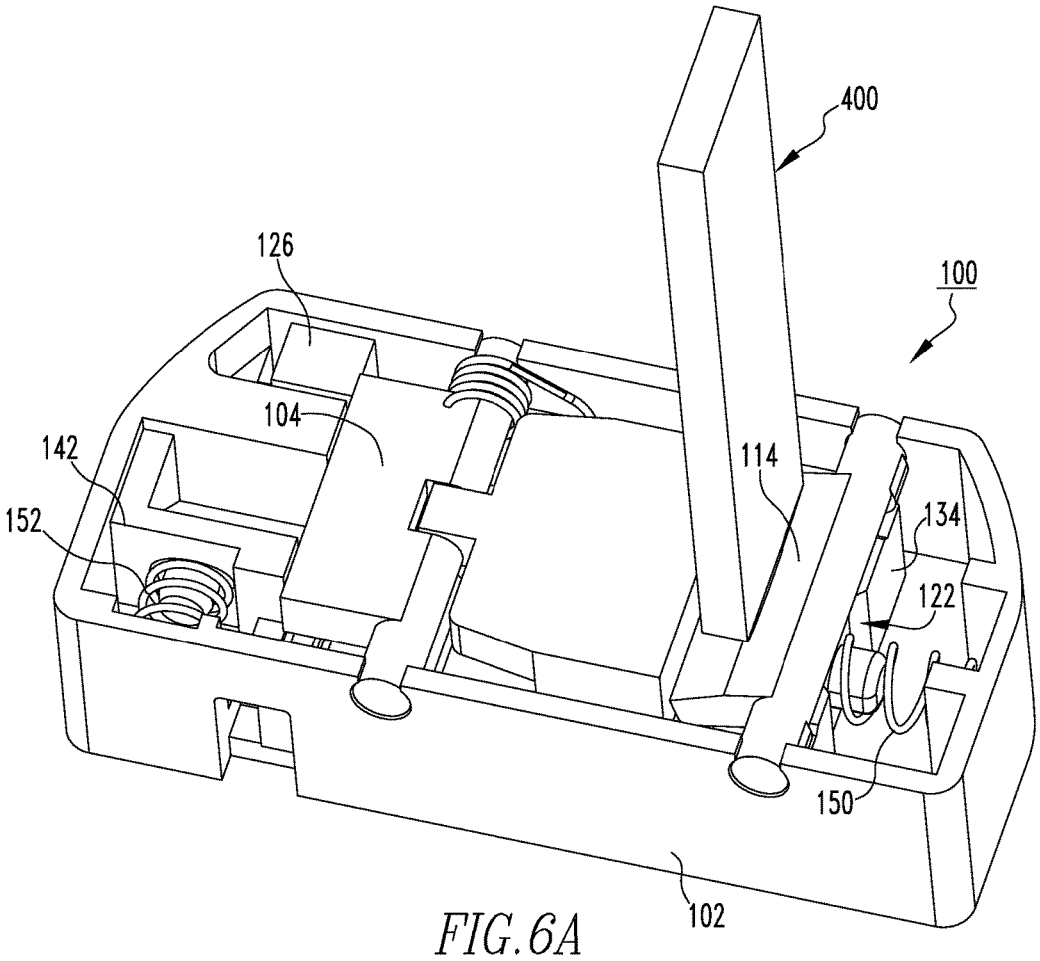
FIG. 6A is an assembled isometric view of the shutter assembly of FIG. 3, and shown with a blade member partially extended into another portion of the shutter assembly and blocked from having access through the shutter assembly.
Figure 6B:
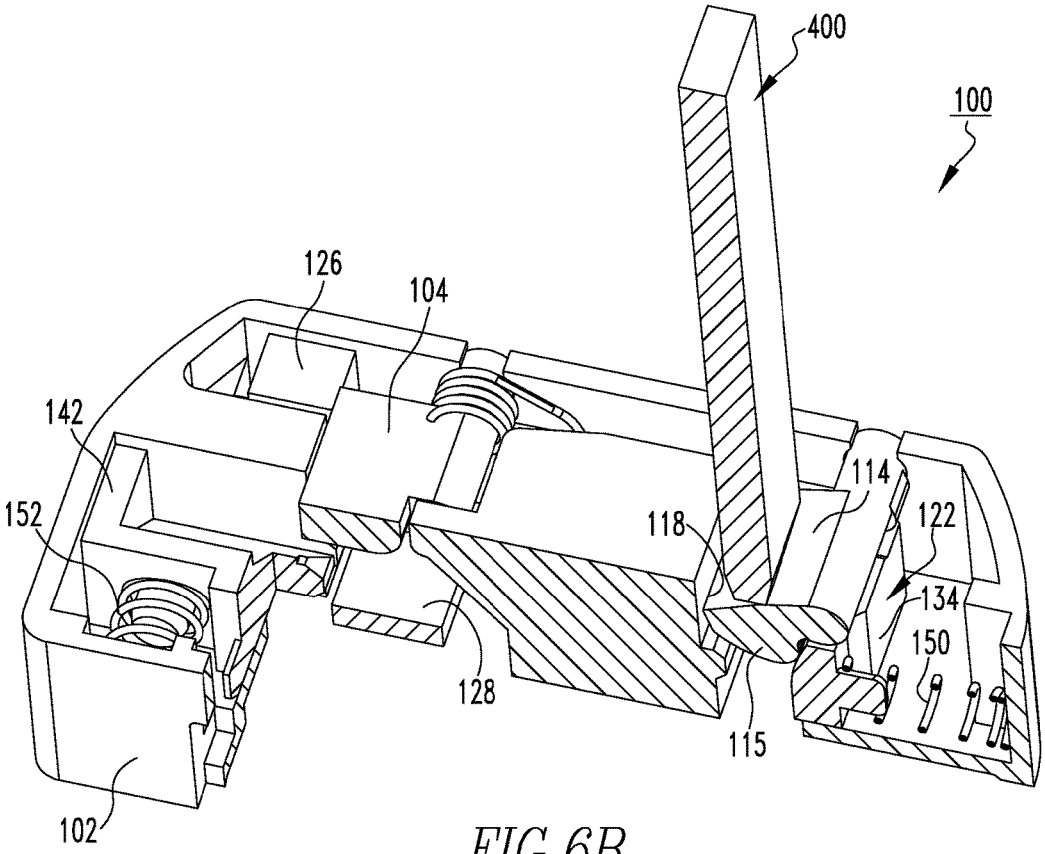
FIG. 6B is an isometric section view of the shutter assembly, with blade member, of FIG. 6A.
Figure 6C:
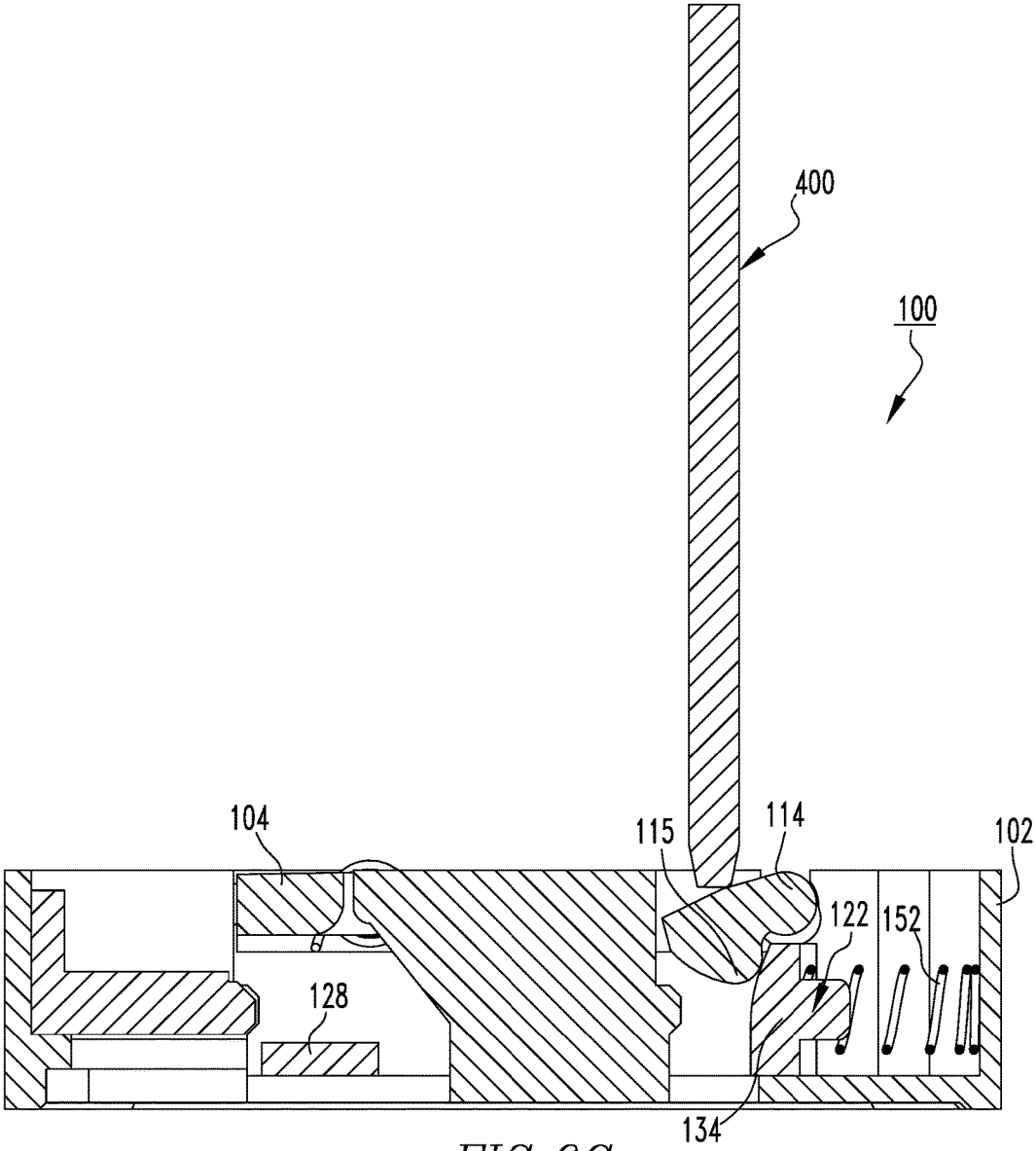
FIG. 6C is an elevation section view of the shutter assembly, with blade member, of FIG. 6A.

FIGS. 6A-6C show different views of the shutter assembly 100 with another blade member 400 partially inserted. As shown most clearly in FIG. 6B, the second shutter 114, which has a bulbous portion 115 in an interior of the shutter assembly 100, has been moved into engagement with the single slider member 122. However, as can be appreciated, further insertion of the blade member 400, e.g., through the shutter assembly 100 and into engagement with an electrical contact of the electrical receptacle 2 (FIGS. 1 and 2), is prevented by virtue of an engagement between the first blocking portion 126 of the slider member 122 and the first shutter 104. That is, rotation of the second shutter 114 from the FIRST position toward the SECOND position without rotation of the first shutter 104 drives the first blocking portion 126 into the first shutter 104 in order to prevent the slider member 122 from sliding from the THIRD position to the FOURTH position.

As depicted in FIGS. 6A-6C, no additional blade members, such as blade members from an electrical plug, have been inserted proximate the first shutter 104. As a result, the first blocking portion 126 of the slider member 122 moves into engagement with the first shutter 104, and the first shutter 104 thus prevents the slider member 122 from sliding to the right, from the perspective of FIG. 6C. If the slider member 122 does not slide to the right, from the perspective of FIG. 6C, then the second shutter 114 cannot fully rotate to the SECOND position (FIGS. 8A-9C). Thus, the blade member 400 is prevented from passing through the shutter assembly 100. This improves safety proximate the second shutter 114 for the same reasons discussed above with respect to FIGS. 5A-5C and the blade member 300.

Figure 7A:
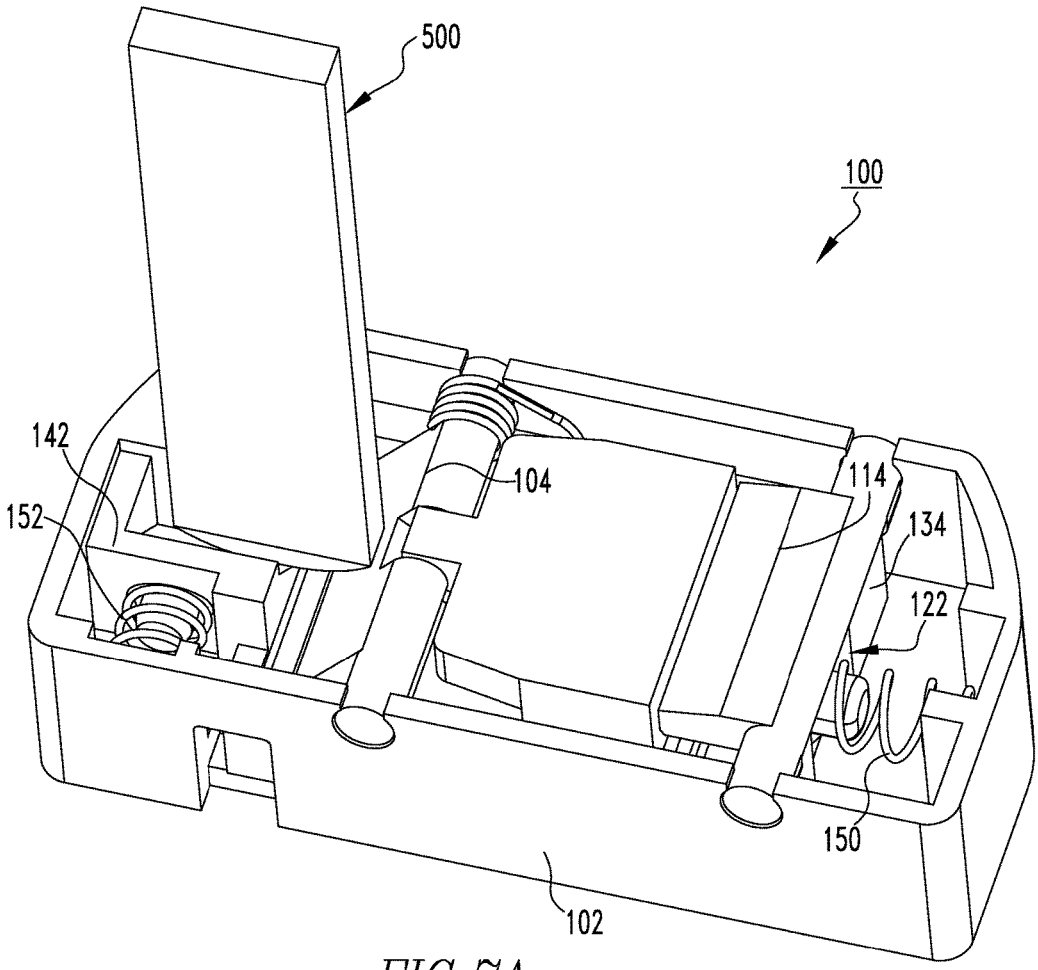
FIG. 7A is an assembled isometric view of the shutter assembly of FIG. 3, and shown with a blade member partially extended into a portion of the shutter assembly and blocked from having access through the shutter assembly.
Figure 7B:
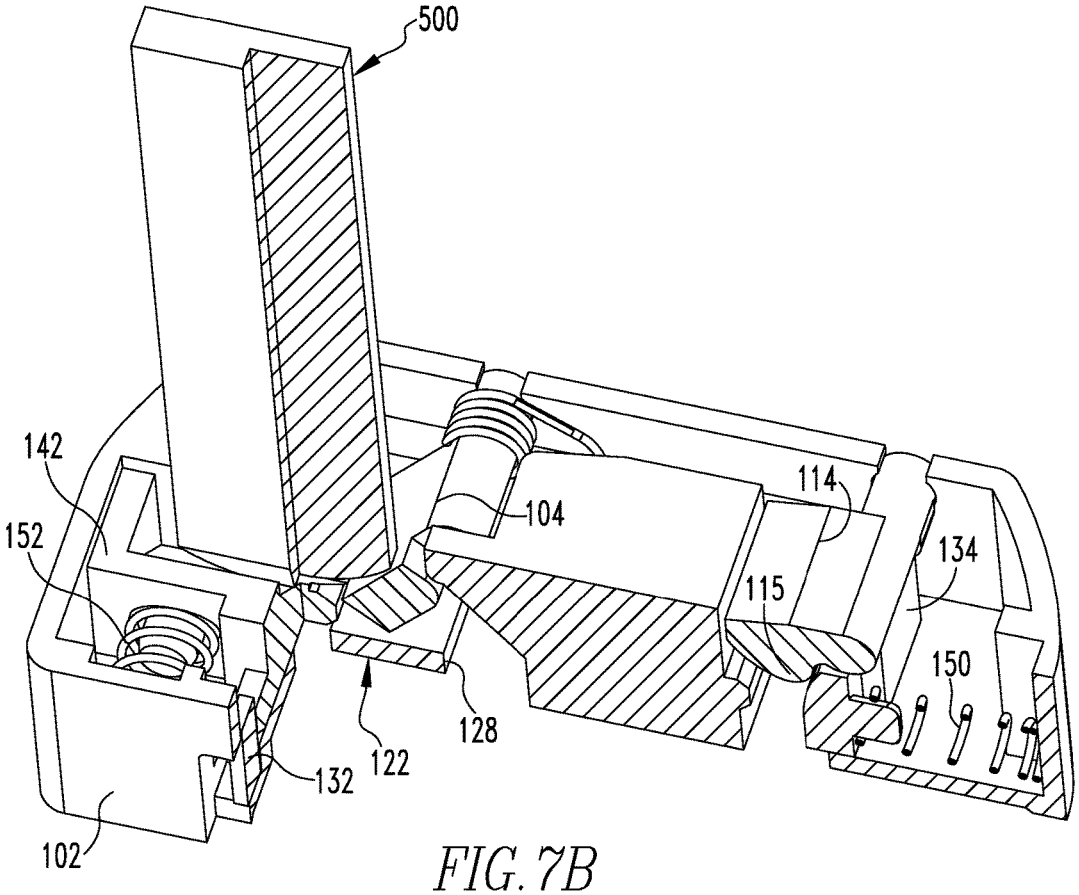
FIG. 7B is an isometric section view of the shutter assembly, with blade member, of FIG. 7A.
Figure 7C:
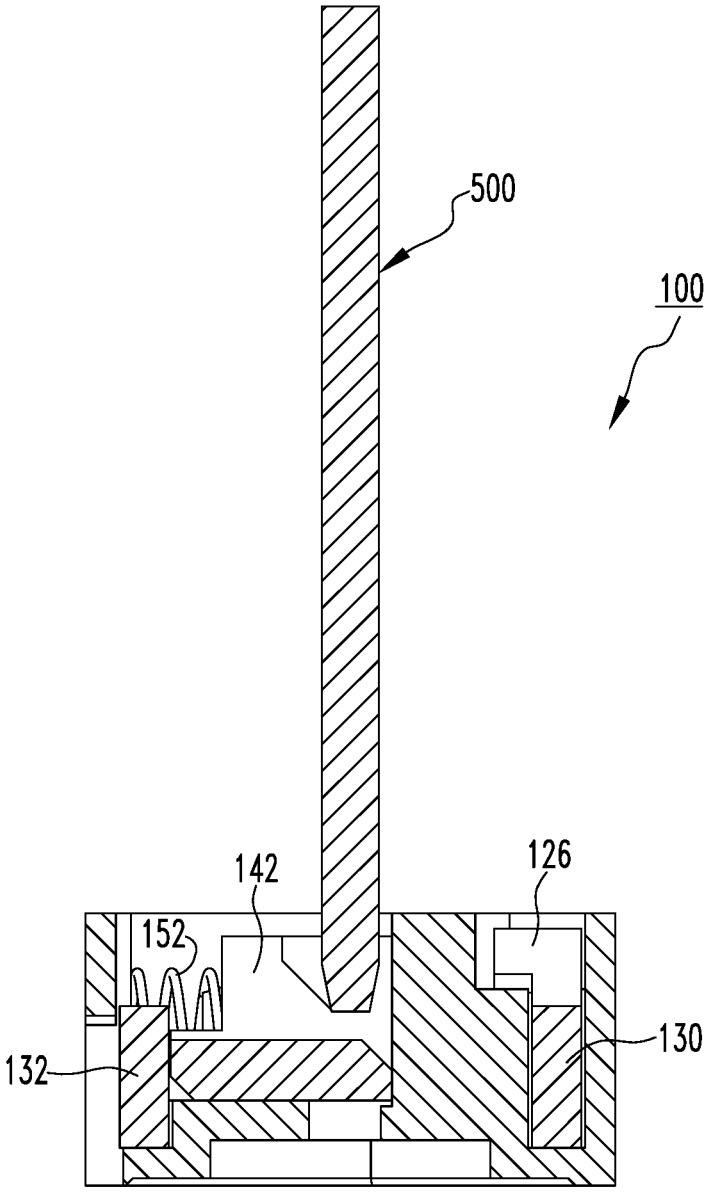
FIG. 7C is a side elevation section view of the shutter assembly, with blade member, of FIG. 7B.

FIGS. 7A-7C show different views of the shutter assembly 100 with another blade member 500 partially inserted, and oriented generally perpendicular to the orientation of the blade members 300,400, discussed above. As shown most clearly in FIG. 7B, the blade member 500 has partially moved the first shutter 104 toward the SECOND position, and has further not even reached engagement with the second blocking portion 128 of the slider member 122. For the same reasons discussed above with respect to the blade member 300 being inserted into the shutter assembly 100 in isolation, the slider member 122 has generally not been moved at all, or at least to the right, from the perspective of FIG. 7B. As such, when the second shutter 114 does not rotate from the FIRST position to the SECOND position and the second slider member 142 slides from the FIFTH position toward the SIXTH position, the second slider member 142 slides into engagement with the first slider member 122 in order to prevent access through the base 102 proximate the second slider member 142. Stated differently, when the blade member 500 moves into engagement with the second slider member 142 without a corresponding blade member being inserted proximate the second shutter 114, the blade member 500 drives the second slider member 142 into engagement with the second leg 132 of the first slider member 122. This engagement prevents the second slider member 142 from fully sliding to the SIXTH position. Accordingly, this prevents the blade member 500 from passing through shutter assembly 100 when the second shutter 114 has not been moved to the SECOND position.

Figure 8A:
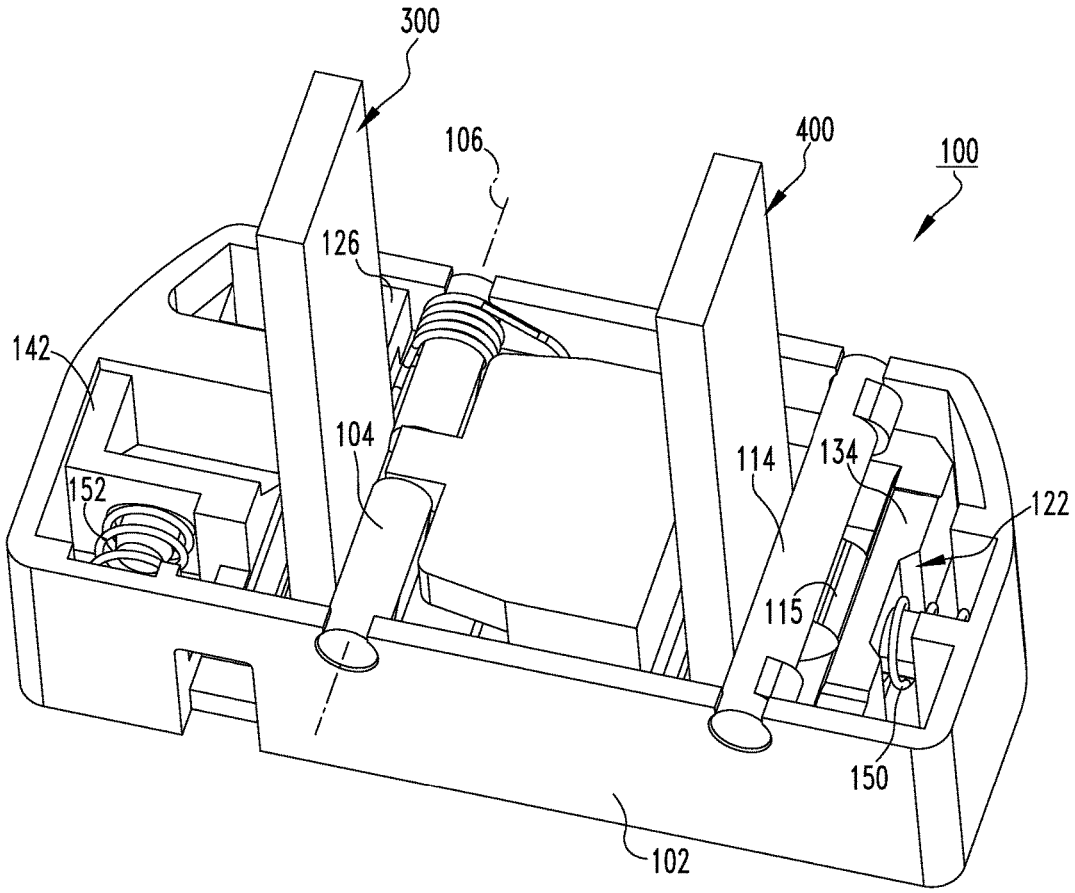
FIG. 8A is a isometric view of the shutter assembly of FIG. 7C, shown with two blade members (e.g., of an electrical plug) extended through the shutter assembly.
Figure 8B:
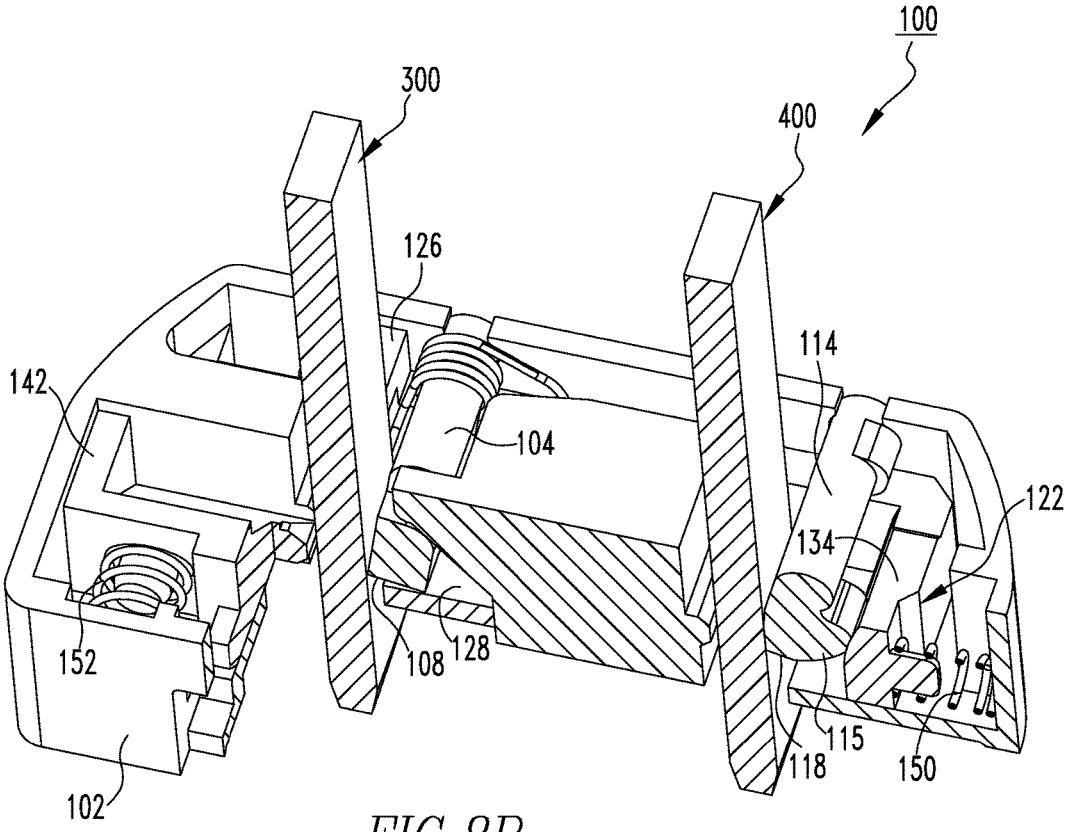
FIGS. 8B and 8C are isometric section and front elevation section views, respectively, of the shutter assembly, with blade members, of FIG. 8A.
Figure 8C:
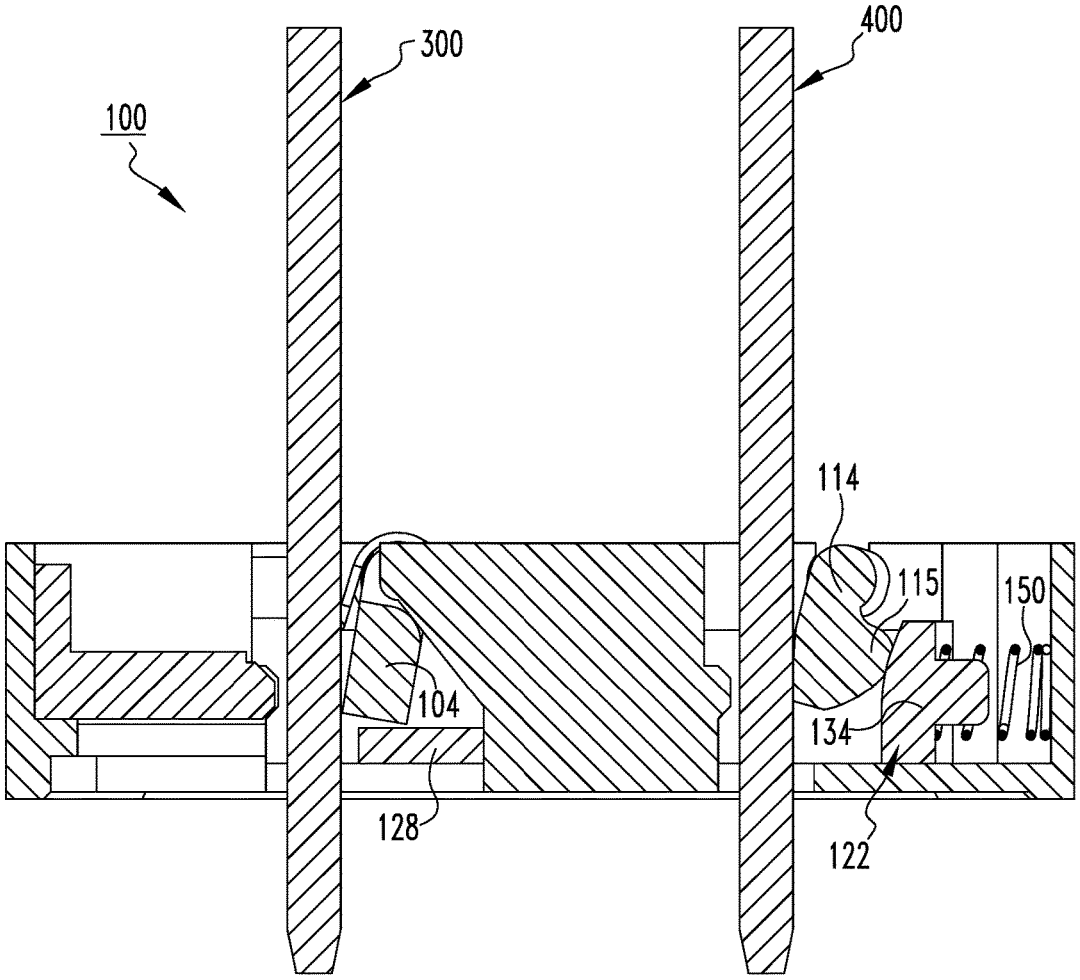

FIGS. 8A-8C show different views of the shutter assembly 100 with blade members 300,400 of an electrical plug, such as a 15 amp plug, inserted entirely through the shutter assembly 100. As shown most clearly in FIGS. 8B and 8C, the shutters 104,114 are in the SECOND position. Accordingly, it will be appreciated that when the blade members 300,400 have both been inserted, the first shutter 104 moves to the SECOND position, thus eliminating the prior blocking engagement between the first blocking portion 126 of the slider member 122 and the first shutter 104. As such, there is nothing to inhibit the slider member 122 from sliding to the right, from the perspective of FIGS. 8B and 8C. That is, with the first shutter 104 moving toward the SECOND position, and eliminating the potential engagement between the first blocking portion 126 and the distal portion 108 of the first shutter 104, the bulbous portion 115 of the second shutter 114, which is driven by the blade member 400, is free to rotate to the SECOND position and drive the slider member 122 to the right. Once the slider member 122 has been driven to the right, from the perspective of FIGS. 8B and 8C, the second blocking portion 128 of the slider member 122 no longer blocks access through the shutter assembly 100. Compare, for example, the position of the second blocking portion 128 in FIG. 5B and FIG. 8B. Thus, operators attempting to insert objects into the electrical receptacle 2 (FIGS. 1 and 2) are provided with a beneficial layer of protection wherein only proper insertion through both of the openings 6,8 of the faceplate 4 will permit passage through the shutter assembly 100.

Figure 9A:
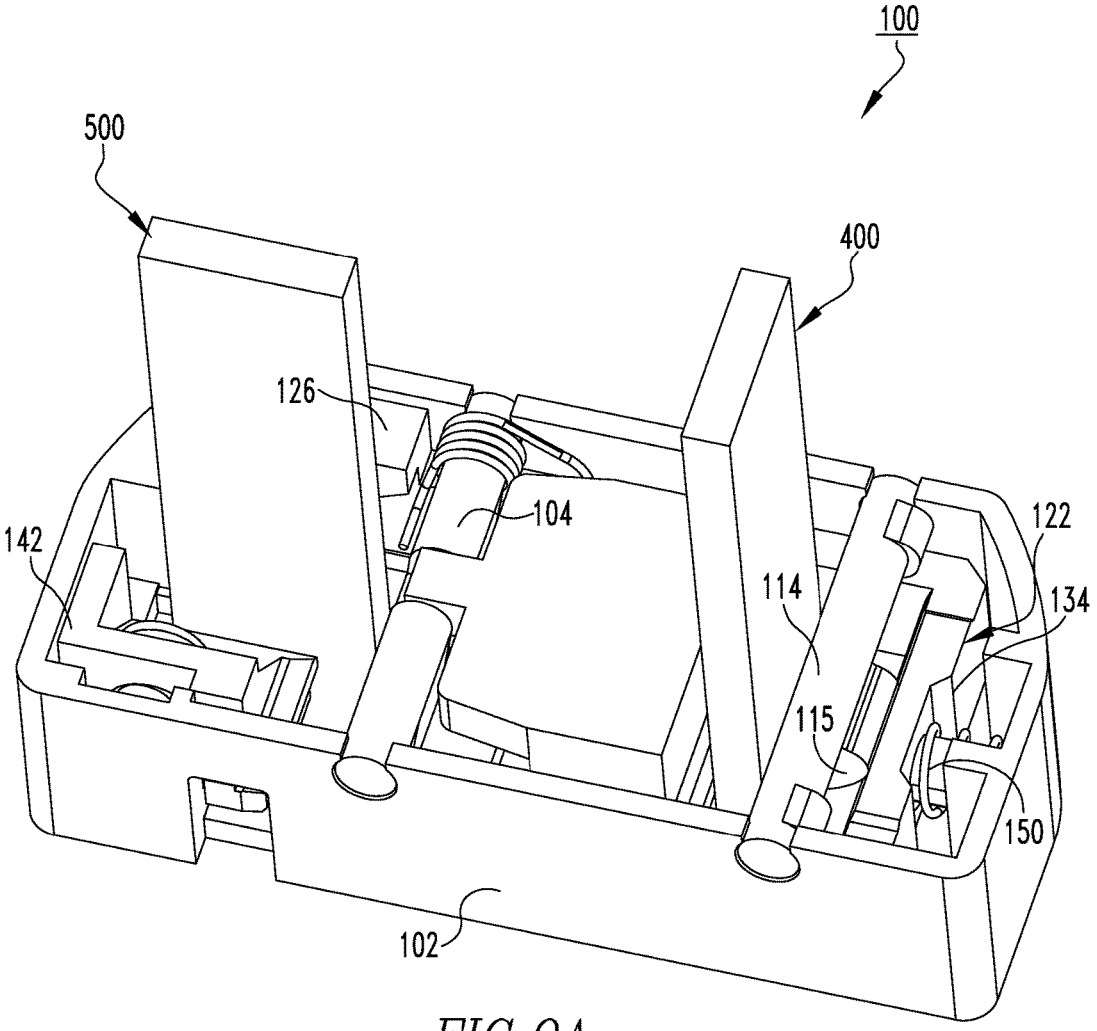
FIG. 9A is an isometric view of the shutter assembly of FIGS. 8B and 8C, shown with two blade members of a different electrical plug extended through the shutter assembly, in accordance with a different aspect of the disclosed concept.
Figure 9B:
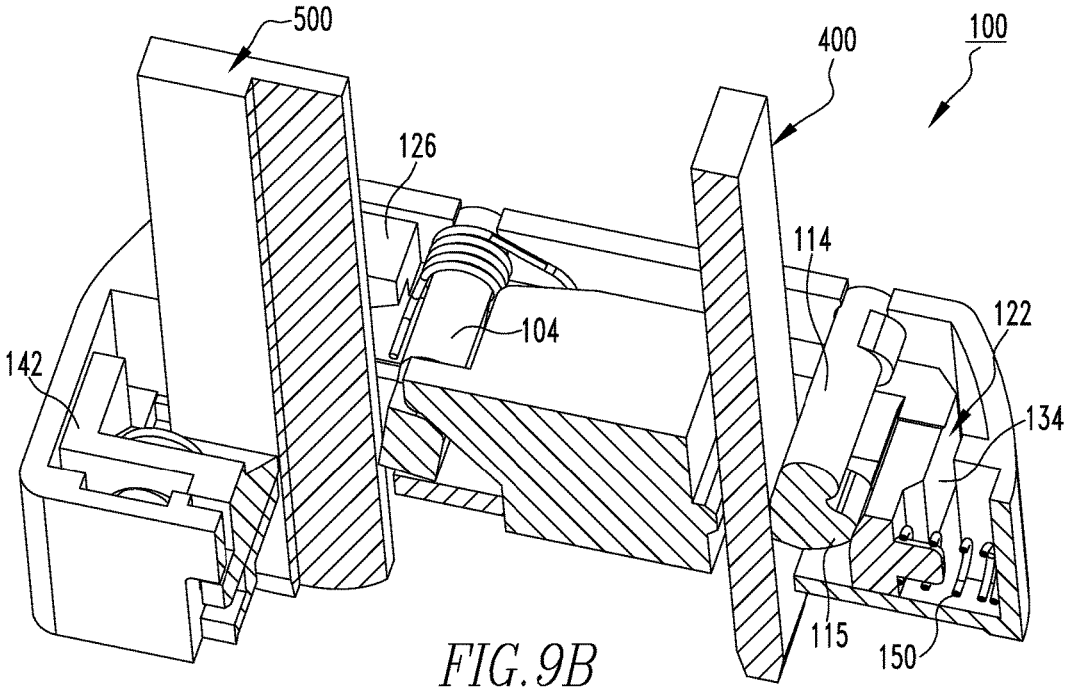
FIGS. 9B and 9C are isometric section and front elevation section views, respectively, of the shutter assembly, with blade members, of FIG. 9A.
Figure 9C:
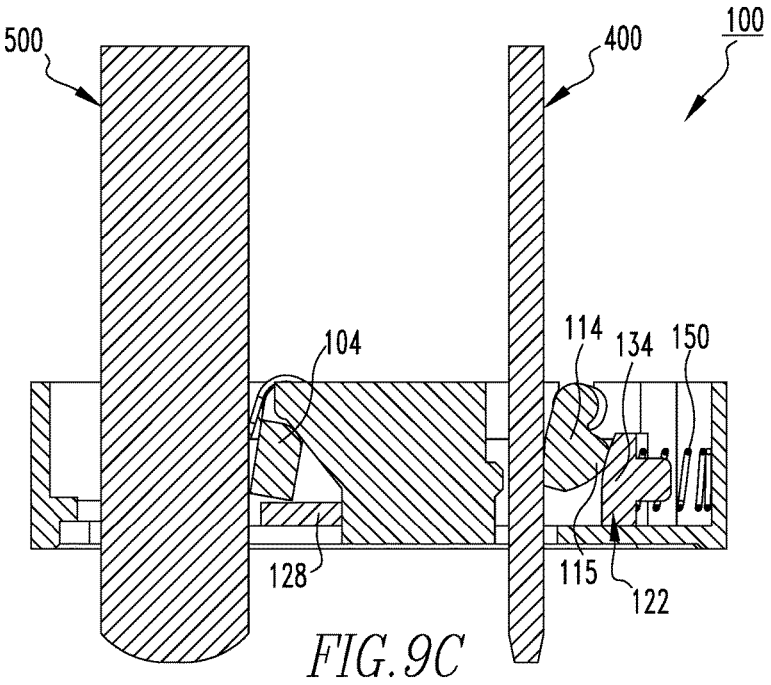

Similarly, FIGS. 9A-9C show different views of the shutter assembly 100 with blade members 400,500 of an electrical plug, such as a 20 amp plug, inserted entirely through the shutter assembly 100. As shown, the blade member 500 of the 20 amp plug is oriented perpendicular to the blade member 400 of the 20 amp plug. It will be appreciated that this blade member 500 would be configured to be inserted through the T-shaped openings 8,18 of the faceplate 4 (FIGS. 1 and 2). As shown most clearly in FIG. 9B, both shutters 104,114 have been moved to the SECOND position. Accordingly, in a similar as discussed above with the blade members 300,400 in FIGS. 8A-8C, with the first shutter 104 rotated to the SECOND position, the first blocking portion will not engage the distal portion 108 of the first shutter 104. As a result, with the first blocking portion 126 not engaging the first shutter 104, the bulbous portion 115 of the second shutter 114, which is driven by the blade member 400, is free to drive the slider member 122 to the right, from the perspective of FIGS. 9B and 9C. With the slider member 122 having slid to the right, the second blocking portion 128 (see FIG. 9B) and the second leg 132 (not shown in FIG. 9B, but see, for example, FIG. 7B) of the slider member 122 correspondingly slide to the right. As shown in FIG. 9B, the second blocking portion 128 does not block access for the blade member 500, and the second slider member 142, which is no longer blocked by the second leg 132 (not shown in FIG. 9B) of the slider member 122, has fully slid to the SIXTH position. Both blade members 400,500 are thus together able to be extended through the shutter assembly 100.

Additionally, the shutter assembly 100 is advantageously provided with a mechanism for the slider members 122,142 to return to the THIRD and FIFTH positions, respectively. More specifically, as shown in FIG. 9B, when the slider member 122 is in the FOURTH position, the spring 150 biases the slider member 122 toward the THIRD position. As such, when the blade members, be it the blade members 300,400, or the blade members 400,500, are together removed from the shutter assembly 100, the spring 150 drives the slider member 122 from the FOURTH position to the THIRD position. Similarly, when the slider member 142 is in the SIXTH position (FIG. 9B), the spring 152 (not shown in FIG. 9B) biases the slider member 142 toward the FIFTH position. Thus, when the blade members 400,500 are together removed from the shutter assembly 100, the spring 152 drives the slider member 142 from the SIXTH position (FIG. 9B) to the FIFTH position.

While the disclosed concept has been described in detail herein in accordance with the shutter assemblies 100,200, it will be appreciated that suitable alternative configurations of shutter assemblies are contemplated. For example and without limitation, while the disclosed concept has provided for both of the shutters 104,114 rotating in the same direction when moving from the FIRST position to the SECOND position (e.g., either both rotate clockwise or both rotate counterclockwise when moving from the FIRST position to the SECOND position), it is contemplated that shutters in a suitable alternative shutter assembly (not shown) may rotate in different directions when moving from FIRST to SECOND positions.

Accordingly, it will be appreciated that the disclosed concept provides for an improved (e.g., without limitation, safer) electrical receptacle 2 and shutter assembly 100,200 therefor, in which a pair of shutters 104,114 and a slider assembly 120 substantially ensure that the electrical receptacle 2 is used properly. More specifically, the shutter assemblies 100,200 substantially minimize and/or eliminate the possibility that a user might insert a single probe member through a single one of the openings 6,8,16,18 of the faceplate 4, and into an electrical contact of the electrical receptacle 2. This safety improvement substantially reduces the possibility for electrocution.

These benefits are provided in part because, when only one of the shutters 104,114 rotates from the FIRST position to the SECOND position, a slider member 122 of the slider assembly 120 is maintained in a THIRD position, thus preventing access through the shutter assembly 100. As a result, passage through the entire shutter assembly 100 (e.g. and the shutter assembly 200) can generally only be provided when both of the shutters 104,114 are moved from a FIRST position to a SECOND position. This protects operators from situations where they might intentionally, or inadvertently, insert only single probe members into one of the shutters 104,114. Specifically, in these situations the single probe members would be prevented from passage through the shutter assembly 100, in a manner described above.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A shutter assembly for an electrical receptacle, said shutter assembly comprising:

a base;

a first shutter and a second shutter each coupled to said base and structured to rotate between a FIRST position and a SECOND position;

a slider assembly comprising a number of slider members each coupled to said base, said number of slider members comprising only one single slider member structured to slide between a THIRD position and a FOURTH position and engage each of said first shutter and said second shutter, wherein rotation of both of said first shutter and said second shutter from the FIRST position to the SECOND position cooperatively drives said one single slider member from the THIRD position to the FOURTH position in order to provide access through said base.

2. The shutter assembly of claim 1 wherein said only one single slider member has a frame portion and a plurality of blocking portions extending from said frame portion; and wherein, rotation of said second shutter from the FIRST position toward the SECOND position without rotation of said first shutter drives a first blocking portion of said plurality of blocking portions into said first shutter in order to prevent said one single slider member from sliding from the THIRD position to the FOURTH position.

3. The shutter assembly of claim 2 wherein said frame portion has a first leg, a second leg, and a middle portion extending therebetween; wherein said number of slider members further comprises an additional slider member structured to slide between a FIFTH position and a SIXTH position; wherein said first shutter is substantially disposed between said additional slider member and said second shutter; and wherein said first blocking portion extends from said first leg toward said additional slider member.

4. The shutter assembly of claim 2 wherein said frame portion has a first leg, a second leg, and a middle portion extending therebetween; wherein said first blocking portion extends from said first leg; wherein said plurality of blocking portions comprises a second blocking portion extending from said first leg to said second leg; and wherein, when only said first shutter rotates from the FIRST position to the SECOND position, said second blocking portion blocks access through said base proximate said first shutter.

5. The shutter assembly of claim 4 wherein said second blocking portion is disposed substantially perpendicular to said first leg and said second leg; and wherein said second blocking portion is spaced from, and disposed substantially opposite and distal said middle portion.

6. The shutter assembly of claim 1 wherein said slider assembly further comprises a biasing element coupled to and extending outwardly from said one single slider member; and wherein, when said one single slider member is in the FOURTH position, said biasing element biases said one single slider member toward the THIRD position.

7. The shutter assembly of claim 6 wherein said one single slider member comprises a frame portion having a first leg, a second leg disposed opposite the first leg, and a middle portion extending therebetween; and wherein said biasing element extends outwardly from said middle portion and is substantially equidistant from said first leg and said second leg.

8. The shutter assembly of claim 1 wherein said one single slider member comprises a frame portion having a first leg, a second leg disposed opposite the first leg, and a middle portion extending therebetween; wherein, when each of said first shutter and said second shutter rotates from the FIRST position to the SECOND position, each of said first shutter and said second shutter has a corresponding axis of rotation and a distal portion disposed opposite and distal the corresponding axis of rotation; and wherein, when each of said first shutter and said second shutter is in the SECOND position, said distal portion of each of said first shutter and said second shutter is disposed between said first leg and said second leg.

9. The shutter assembly of claim 1 wherein, when only one of said first shutter and said second shutter rotates from the FIRST position to the SECOND position, said only one single slider member is maintained in the THIRD position.

10. The shutter assembly of claim 1 wherein said number of slider members further comprises an additional slider member structured to slide between a FIFTH position and a SIXTH position; and wherein said first shutter is substantially disposed between said additional slider member and said second shutter.

11. The shutter assembly of claim 10 wherein, when said one single slider member slides between the THIRD position and the FOURTH position, said one single slider member generally slides on a first axis; and wherein, when said additional slider member slides between the FIFTH position and the SIXTH position, said additional slider member slides on a second axis perpendicular to the first axis.

12. The shutter assembly of claim 10 wherein, when said second shutter does not rotate from the FIRST position to the SECOND position and said additional slider member slides from the FIFTH position toward the SIXTH position, said additional slider member slides into engagement with said one single slider member in order to prevent access through said base proximate said additional slider member.

13. The shutter assembly of claim 10 wherein said slider assembly further comprises a biasing element coupled to and extending outwardly from said additional slider member; and wherein, when said additional slider member is in the SIXTH position, said biasing element biases said additional slider member toward the FIFTH position.

14. The shutter assembly of claim 1 wherein, when said first shutter rotates from the FIRST position to the SECOND position, said first shutter rotates counterclockwise; and wherein, when said second shutter rotates from the FIRST position to the SECOND position, said second shutter rotates counterclockwise.

15. An electrical receptacle comprising:

a faceplate; and a shutter assembly comprising:

a base coupled to said faceplate, a first shutter and a second shutter each coupled to said base and structured to rotate between a FIRST position and a SECOND position, a slider assembly comprising a number of slider members each coupled to said base, said number of slider members comprising only one single slider member structured to slide between a THIRD position and a FOURTH position and engage each of said first shutter and said second shutter, wherein rotation of both of said first shutter and said second shutter from the FIRST position to the SECOND position cooperatively drives said one single slider member from the THIRD position to the FOURTH position in order to provide access through said base.

16. The electrical receptacle of claim 15 wherein said only one single slider member has a frame portion and a plurality of blocking portions extending from said frame portion; and wherein, rotation of said second shutter from the FIRST position toward the SECOND position drives a first blocking portion of said plurality of blocking portions into said first shutter in order to prevent said one single slider member from sliding from the THIRD position to the FOURTH position.

17. The electrical receptacle of claim 15 wherein said one single slider member comprises a frame portion having a first leg, a second leg disposed opposite the first leg, and a middle portion extending therebetween; wherein, when each of said first shutter and said second shutter rotates from the FIRST position to the SECOND position, each of said first shutter and said second shutter has a corresponding axis of rotation and a distal portion disposed opposite and distal the corresponding axis of rotation; and wherein, when each of said first shutter and said second shutter is in the SECOND position, said distal portion of each of said first shutter and said second shutter is disposed between said first leg and said second leg.

18. The electrical receptacle of claim 15 wherein said number of slider members further comprises an additional slider member structured to slide between a FIFTH position and a SIXTH position; and wherein said first shutter is substantially disposed between said additional slider member and said second shutter.

19. The electrical receptacle of claim 18 wherein, when said second shutter does not rotate from the FIRST position to the SECOND position and said additional slider member slides from the FIFTH position toward the SIXTH position, said additional slider member slides into engagement with said one single slider member in order to prevent access through said base proximate said additional slider member.

20. The electrical receptacle of claim 18 wherein said slider assembly further comprises a biasing element coupled to and extending outwardly from said one single slider member; wherein, when said one single slider member is in the FOURTH position, said biasing element biases said one single slider member toward the THIRD position; wherein said one single slider member comprises a frame portion having a first leg, a second leg disposed opposite the first leg, and a middle portion extending therebetween; and wherein said biasing element extends outwardly from said middle portion and is substantially equidistant from said first leg and said second leg.

* * * * *